United States Patent [19]

Feighery et al.

[11] 3,943,864

[45] Mar. 16, 1976

[54] CARPET SEWING MACHINE

[75] Inventors: James M. Feighery; Michael A. Lewallyn, both of Dalton, Ga.

[73] Assignee: J. M. Feighery Company, Dalton, Ga.

[22] Filed: Dec. 16, 1974

[21] Appl. No.: 533,343

[52] U.S. Cl. ..... 112/7; 112/121.14; 112/8

[51] Int. Cl.[2] ..... D05B 23/00

[58] Field of Search..... 112/121.14, 7, 3 R, 162, 112/441, 124, 199, 217.3, 258, 8; 83/483, 485, 487

[56] References Cited

UNITED STATES PATENTS

| | | | |
|---|---|---|---|
| 275,966 | 4/1883 | Whitney | 112/258 |
| 929,653 | 8/1909 | Bonney | 112/124 |
| 2,023,316 | 12/1935 | Ebert | 112/162 |
| 2,609,768 | 9/1952 | Cash et al. | 112/3 R |
| 2,918,884 | 12/1959 | Kalning et al. | 112/3 R |
| 3,396,686 | 8/1968 | Davidson et al. | 112/121.14 |
| 3,757,618 | 9/1973 | Kuts | 83/483 X |

*Primary Examiner*—Werner H. Schroeder
*Assistant Examiner*—Peter Nerbun
*Attorney, Agent, or Firm*—B. P. Fishburne, Jr.

[57] ABSTRACT

A carriage-mounted sewing machine with special stitch forming means and an advance power trimmer are driven as a unit along the rails of a railway sewing machine bed by operation of the sewing machine motor and a unique clutch arrangement coupled with the carriage train drive for the railway bed. The stitching mechanism features an improved looper arrangement whereby precisely the necessary degree of slack is produced in the butt seam stitches to enable the spliced carpet sections to "butt out" perfectly without a gap and without overlapping at the butt seam or buckling. A specialized presser foot and throat plate arrangement allows the butt seaming of carpet sections up to two inches in total thickness. Carpet scrap is reduced to a minimum.

4 Claims, 17 Drawing Figures

FIG. 9
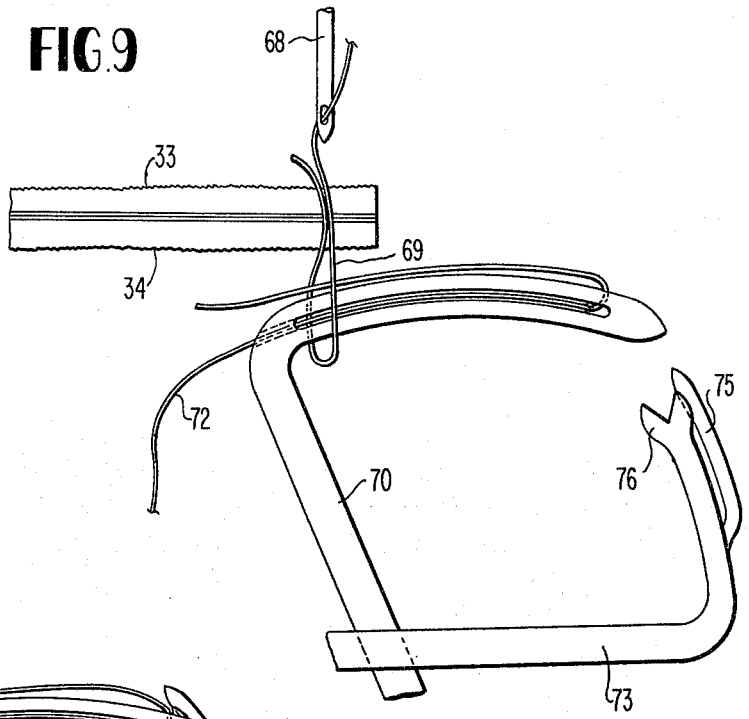
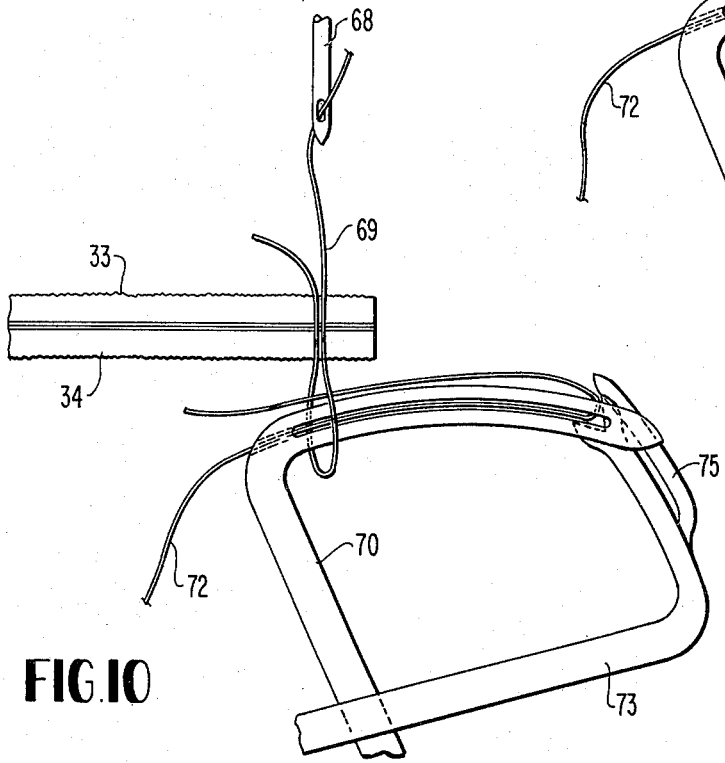
FIG. 10
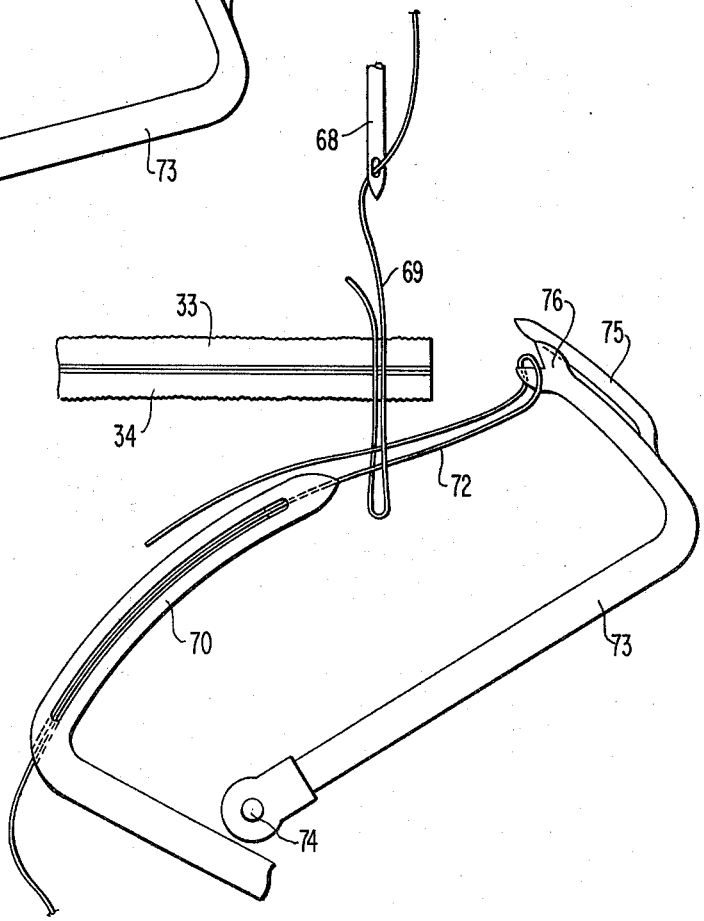
FIG. 11

FIG. 12
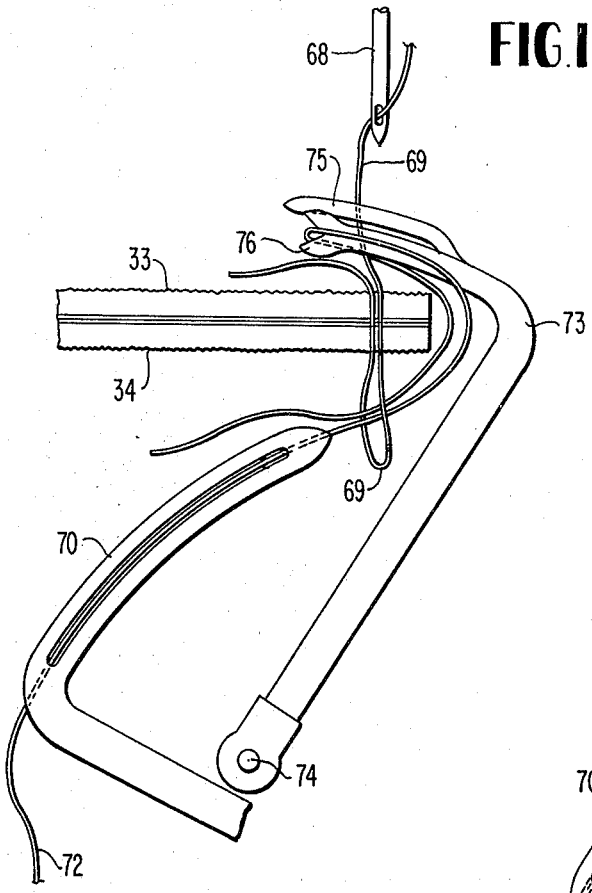
FIG. 13
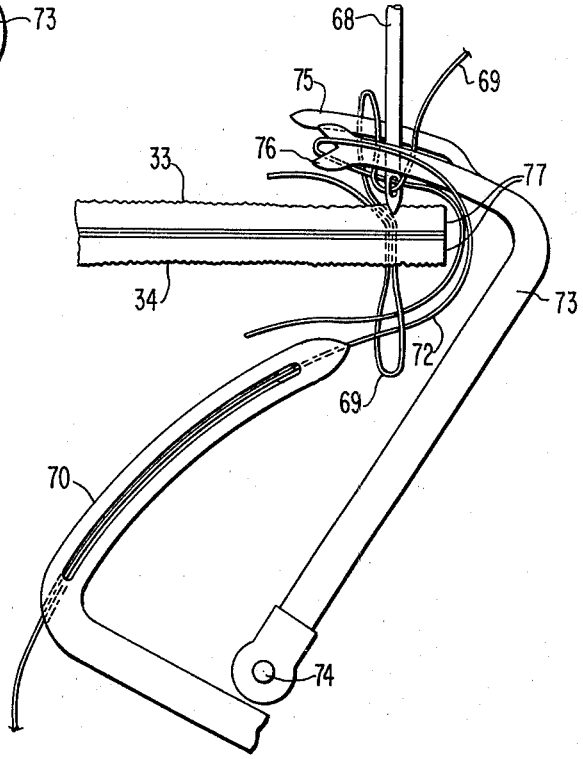
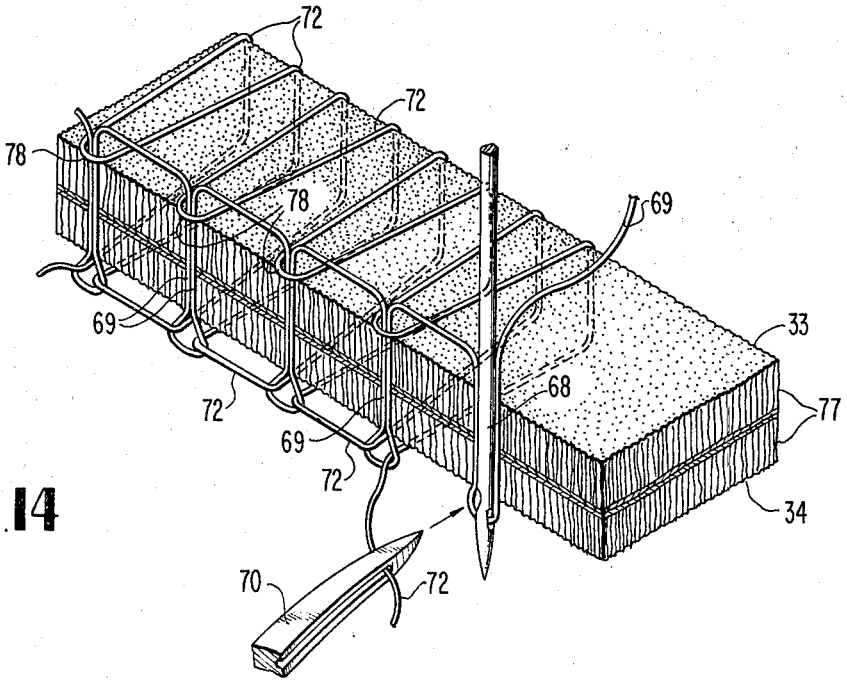
FIG. 14

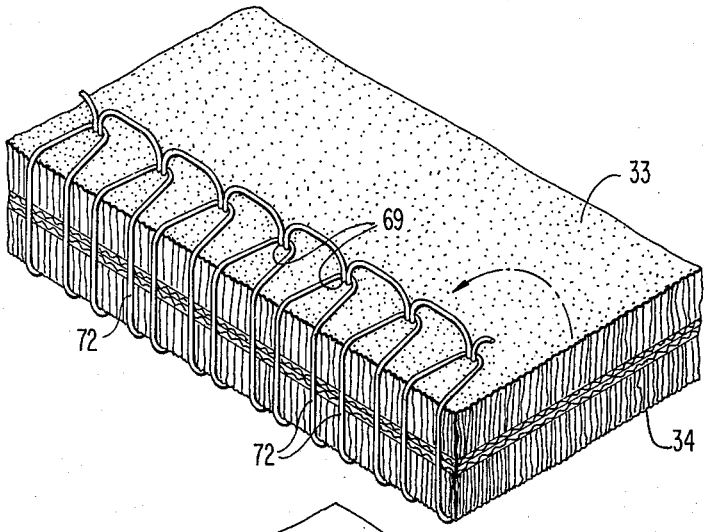
FIG. 15
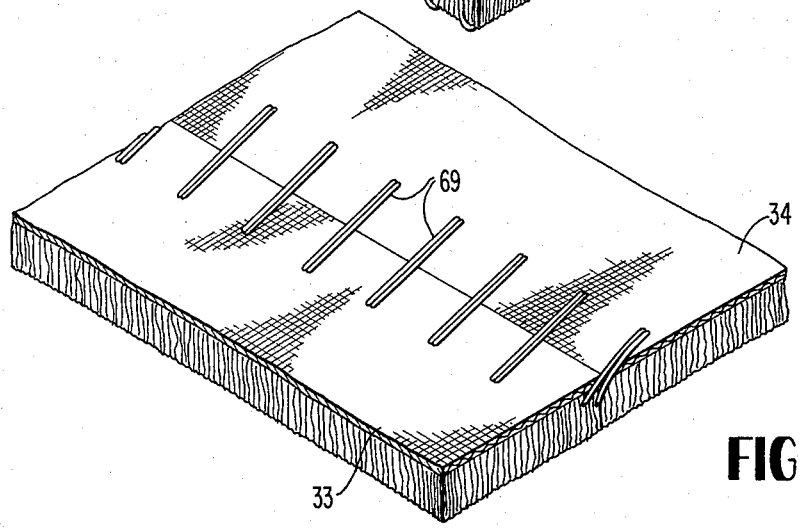
FIG. 16
FIG. 17
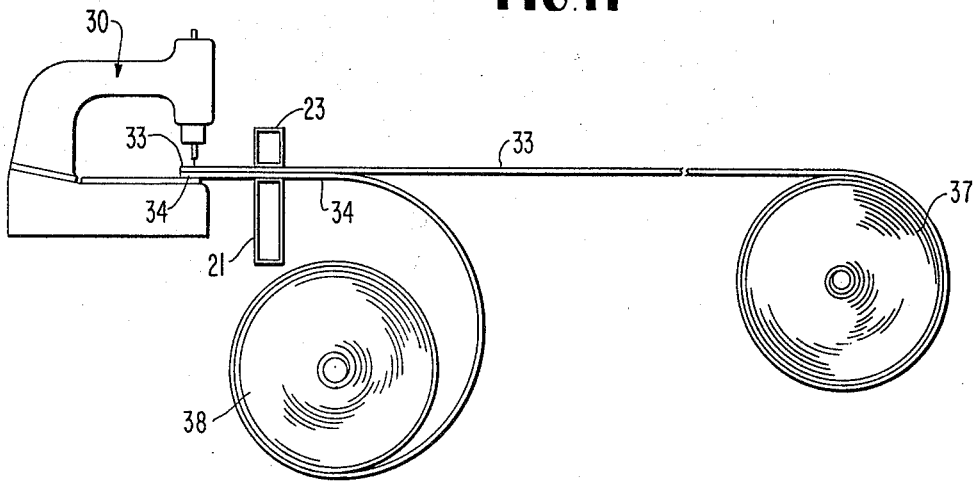

CARPET SEWING MACHINE

BACKGROUND OF THE INVENTION

The formation of a neat, secure and practically invisible seam or splice between two sections or rolls of modern-day wide gage carpet has been a formidable problem for quite some time in the industry. The older method for seaming carpet sections with a lap seam causes two joined carpet edges to protrude at about 90° from the carpet plane, and in addition to being unsightly causes difficulties in a shearing machine in that the machine must be stopped and its blades elevated so that the spliced carpet may be advanced with its protruding seam beyond the shearing blades. The customary lap seam causes at least a 12 inch waste strip on a 15 foot wide carpet roll, and a similar wastage will occur with the carpet printing operation. The carpet industry for a long time has wasted thousands of dollars daily because of the customary lap seaming of carpeting.

In awareness of the above industry problem, some prior art proposals have been brought forth with the objective of forming butt seams between carpet edges which require joining and some examples of the known patented prior art for this purpose are contained in U.S. Pat. Nos. 2,655,885 and 3,440,981. So-called railway sewing machines of more general utility are also known in the prior art.

In general, the prior art proposals for producing butt seams or splices between carpet sections have not been entirely satisfactory and practical for several reasons. Among these reasons is the inability of conventional sewing machines to handle the large thicknesses of modern-day pile carpeting where two superposed sections to be joined will measure up to 2 inches in thickness. Also, the prior art machines customarily can handle only a single thickness or gage of much less than the above-specified total thickness which the machine of the present invention can easily handle. In the invention, a novel presser foot and throat plate structure is provided to deal with this thickness problem and works with great efficiency.

More importantly, the prior art machines seem to be incapable through their stitch-forming mechanisms to consistently form a butt seam with precisely the required slack in the stitches to eliminate gapping between the two carpet sections or overlapping the buckling at the seam as when insufficient slack is present in the stitching. By means of an improved and very efficient sewing head involving a novel looper arrangement, and increased sewing needle stroke, the machine of the invention has been enabled to form consistently and reliably an ideal butt seam or splice between wide carpet sections which is almost perfectly uniform across the full width of wide gage carpet, up to fifteen feet and more. More particularly, a novel extension finger on one of the two loopers of the stitch-forming mechanism assures the formation of precisely the proper amount of slack in the thread from which the butt seam stitches are formed, thus enabling the two joined carpet sections to "butt out" in the desired manner after formation of the seam and the unfolding of the two carpet sections into a common plane. The butt seam produced by means of the invention can be made virtually invisible and certainly far superior in appearance as well as durability and consistency to anything heretofore known in the industry.

Another very important improvement feature over the prior art in the present machine is the pivotal mounting of the sewing machine or head and the powered carpet trimmer immediately in advance of the sewing head on the carriage which supports both. This pivotal mounting of sewing machine and trimmer on right angular pivot axes enables a mechanic to easily gain access to the sewing head for making repairs without the necessity for removing the machine from the carriage or railway bed. This represents another significant saving of labor and time.

Still another important feature of the invention resides in the mated arrangement of the power trimmer and sewing machine on the common carriage in such a way that the trimmer produces a perfectly straight edge on the carpet sections immediately ahead of the stitching operation, with the scrap trimmings falling to the floor prior to the entry of the carpet sections into the stitch forming mechanism. Carpet scrap or waste is reduced to the absolute minimum by means of the invention.

Another significant feature of the invention resides in the use of an electric clutch between the driving sprocket for the carriage and the gear speed reducer coupled with the sewing machine drive motor. By this arrangement, the clutch will be energized only when the electric drive motor is energized so as to propel the carriage carrying the sewing machine and trimmer along the railway bed through the engagement of the carriage drive sprocket and a fixed length of sprocket chain which spans the railway bed lengthwise. When the sewing machine motor is off, the electric clutch becomes inactive and thus allows the carriage to be wheeled manually anywhere along the track of the railway frame, the drive sprocket for the carriage merely free-wheeling at this time.

Other important features and advantages of the invention will become apparent during the course of the following detailed description.

BRIEF DESCRIPTION OF DRAWING FIGURES

Figure 1:
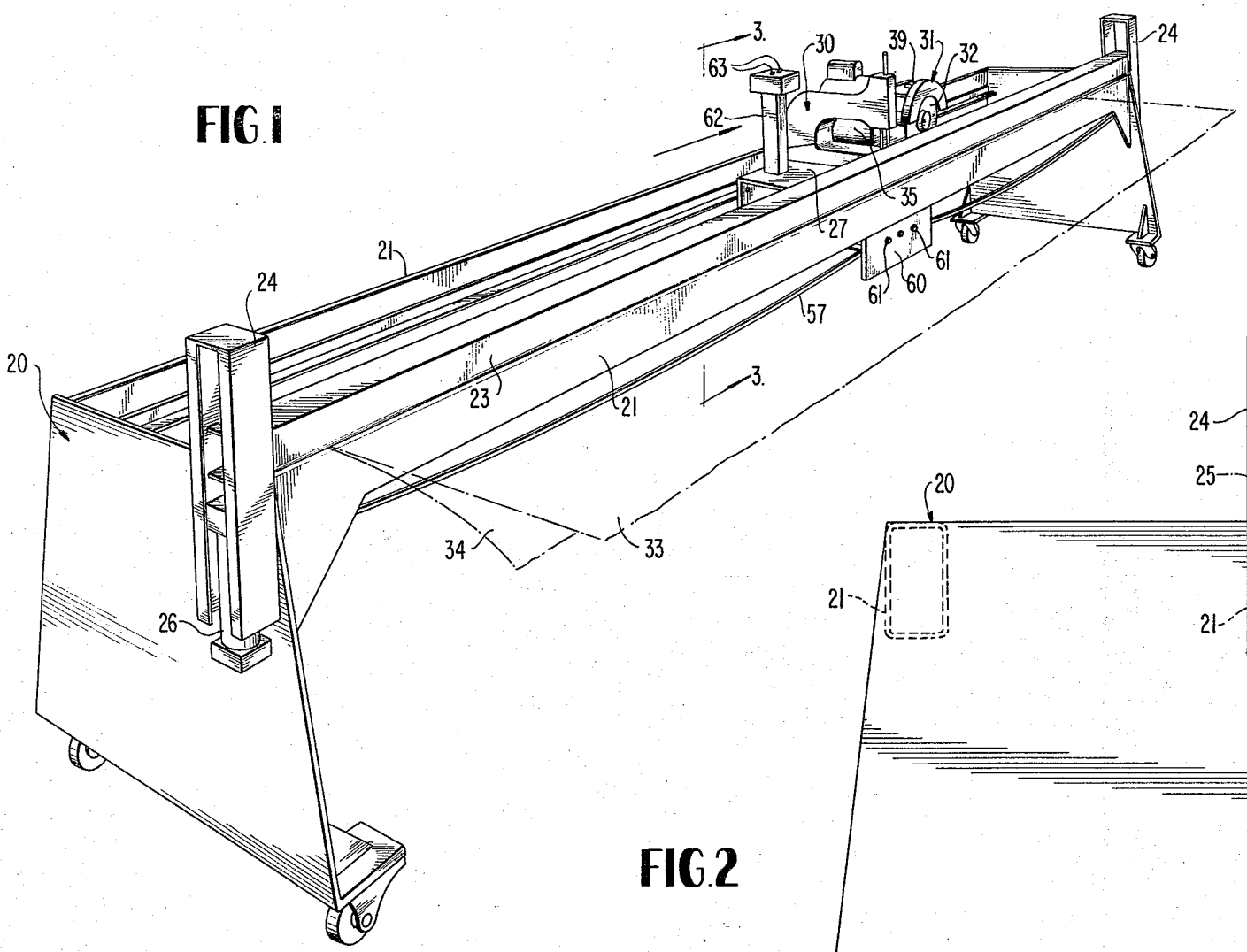
FIG. 1 is a perspective view of a carpet butt seam forming machine embodying the invention.

FIGS. 7 to 13, inclusive, are sequential views showing the step-by-step formation of stitching with proper slack to produce a butt joint between carpet sections which will butt out properly.

FIG. 14 is a fragmentary perspective view of two superposed carpet sections and the butt seaming of stitching formed by the machine and still being formed by the cooperating needle and looper mechanism.

FIG. 15 is a further perspective view of the superposed carpet sections viewed at their leading edges after completion of the stitching and prior to the butting out of the seam or joint.

FIG. 16 is a perspective view of the finished butt seam after swinging of the spliced carpet sections into a common plane in the butting out operation.

FIG. 17 is a schematic end elevational view showing the joining of the ends of old and new carpet rolls by the invention.

DETAILED DESCRIPTION

Referring to the drawings in detail wherein like numerals designate like parts, and referring initially to FIGS. 1 through 6, a railway sewing machine frame or base 20 includes two parallel elevated side rails 21, each supporting a carriage guide track 22 along the inner side and bottom thereof, and extending continuously for the length of the railway bed, or frame.

Figure 2:
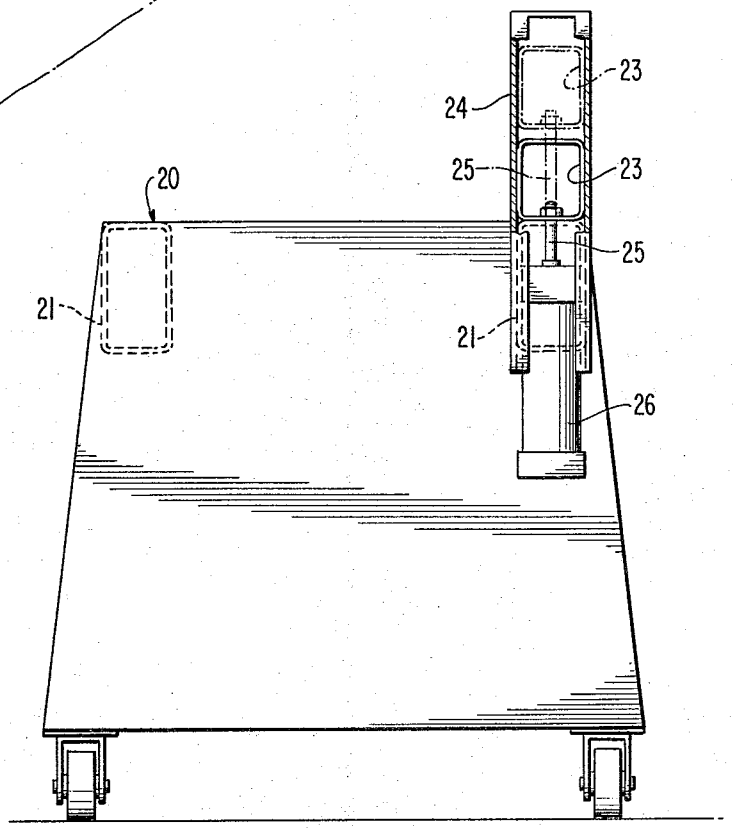
FIG. 2 is an end elevational view thereof, partly in section, to show more clearly an air-operated carpet clamping means.
Figure 3:
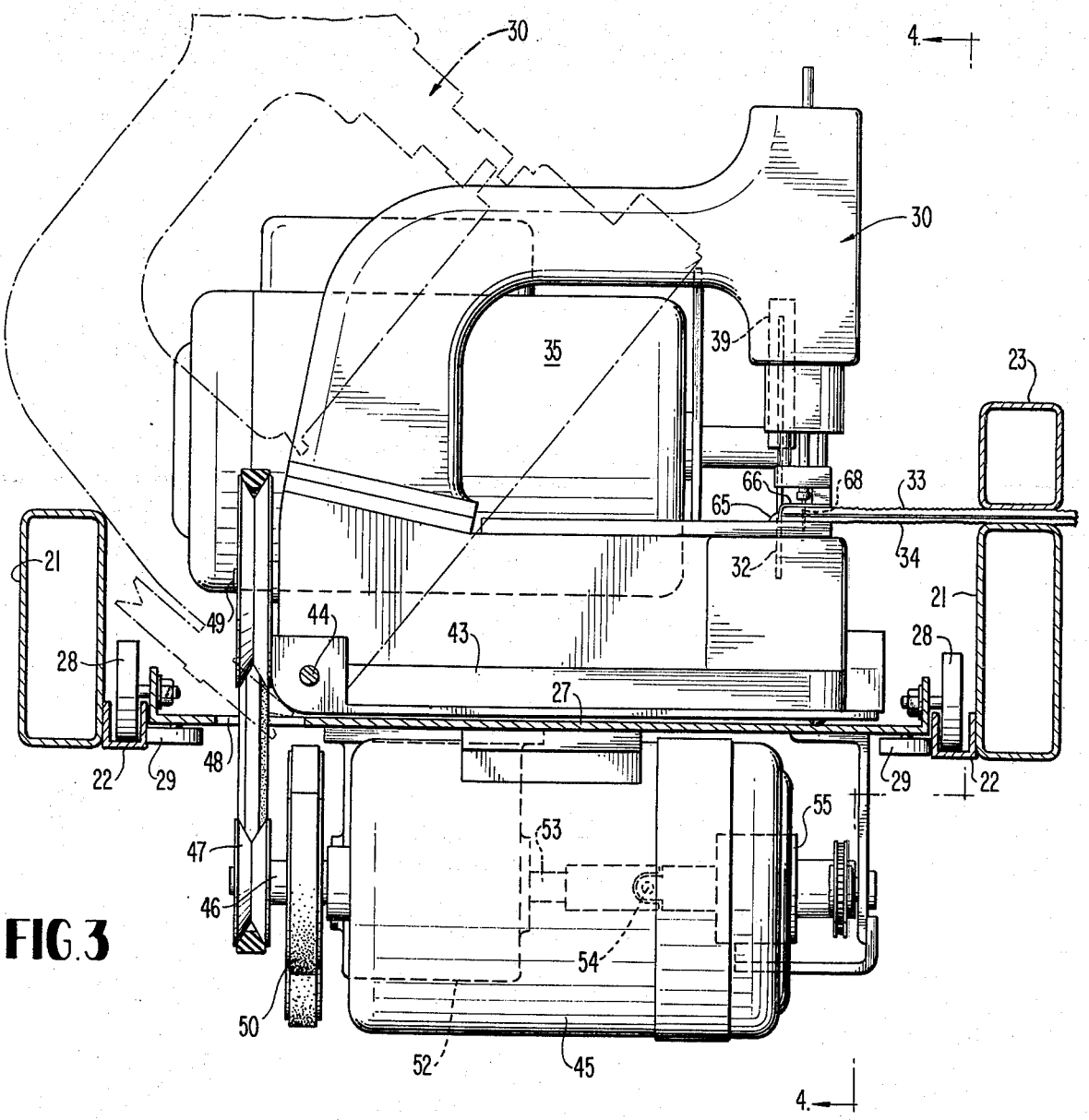
FIG. 3 is an enlarged transverse vertical section through the machine taken substantially on line 3—3 of FIG. 1.

At one side of the railway frame, a power-operated carpet clamping bar 23 extends coextensively with and parallel to the adjacent frame rail 21. This clamping bar 23 is guided for vertical movement by end vertical guideways 24 on the frame 20 and rigid therewith. The ends of clamp bar 23 are secured to piston rods 25 of air cylinder raising and lowering units 26 also located at the ends of the frame 20, and having conventional controls to coordinate their operation so that the clamp bar at proper times may be raised to a non-clamping position or lowered to an active clamping position, both positions being shown in FIG. 2 is broken and full lines, respectively. The clamping bar always remains parallel to the underlying rail 21 which forms the other element of the carpet bar clamping means along one side of the machine.

A carriage plate 27 forming the movable support of a sewing machine and trimmer, yet to be described, has paired vertical and horizontal guide rollers 28 and 29 at its four corners rollingly engaging horizontal and vertical flanges of the parallel guide tracks 22, whereby the carriage plate is accurately guided in its movement along the railway frame 20.

A modified sewing machine 30 and a power trimmer 31 are bodily mounted on carriage plate 27 to travel therewith, with the trimmer 31 immediately ahead of the sewing machine, FIG. 1, with reference to the forward direction of movement of the carriage during the carpet butt seaming operation, as indicated by the arrow in FIG. 1.

Figure 4:
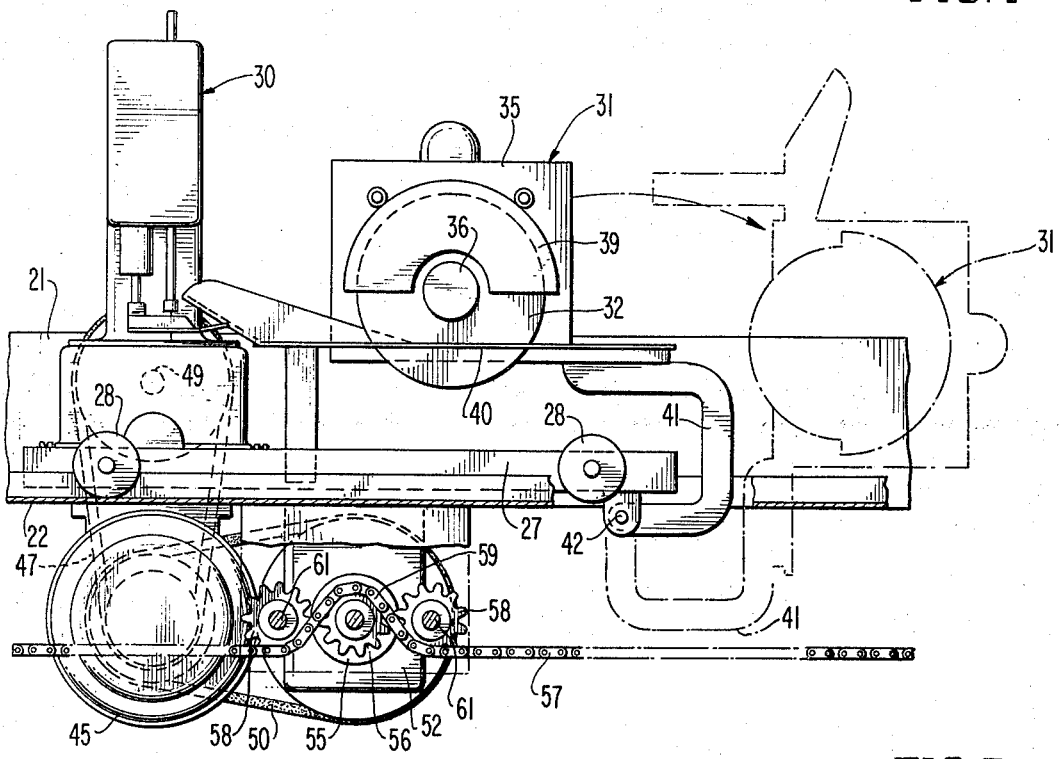
FIG. 4 is a vertical section taken on line 4—4 of FIG. 3.
Figure 5:
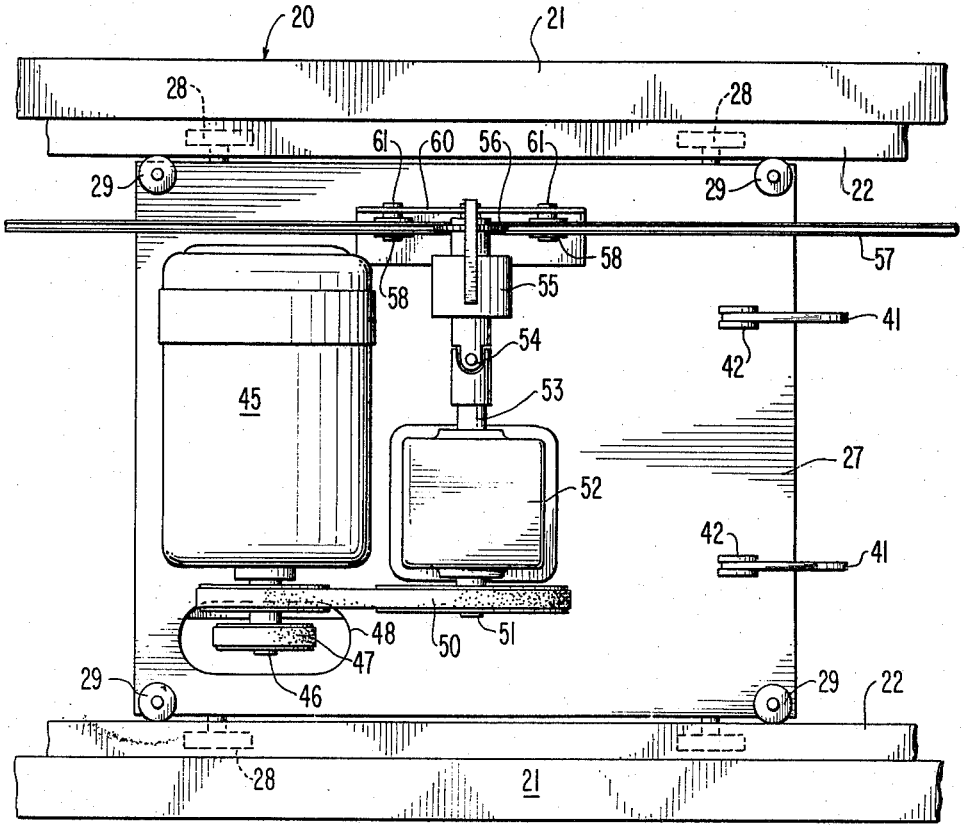
FIG. 5 is a bottom plan view of the carriage and other mechanism in FIG. 4.

The trimmer 31 has a vertical trimming blade 32 whose lower edge projects somewhat below the top edge of the adjacent rail 21, FIG. 4, to enable the rotary trimming blade to cut through two thick layers of carpet 33 and 34 while the same are being firmly gripped by the clamp bar 23. The trimmer unit has an independent electric drive motor 35 to power the horizontal drive shaft 36 of circular blade 32. As shown in the drawings, this trimmer blade operates in a vertical plane slightly inwardly of the sewing maching needle so as to trim off narrow strips of excess carpeting from the two layers 33 and 34, just ahead of the stitching operation as the carriage is moving along the railway tracks. A minimum of carpet waste is entailed and the sewing machine need not be stopped in its operation until the two carpet sections are completely spliced or butt seamed along their entire widths. It will be appreciated that the carpet sections 33 and 34 are respectively attached to old or nearly exhausted and new carpet rolls 37 and 38 in the practical operation of the machine, as schematically shown in FIG. 17.

The trimmer blade 32 has an upper guard 39 for safety and the lower edge of the blade projects through a slotted horizontal plate 40 forming a customary part of the power trimmer.

To assist a mechanic in repairing the equipment without the necessity for removing the sewing machine 30 from the carriage plate 27, both the trimmer 31 and sewing machine are pivotally mounted to the carriage plate on pivot axes which extend at right angles to each other. Referring to FIG. 4, the trimmer unit 31 including its motor is secured fixedly to the tops of a spaced pair of U-shaped hinge arms 41 which extend in vertical planes around the forward edge of carriage plate 27 and are pivotally secured to the lower side of the carriage plate near its leading edge, as indicated at 42 in the drawings. The pivot or hinge axis for the trimmer 31, therefore, extends transversely of the carriage guide tracks 42. In FIG. 4, the trimmer 31 is shown in broken lines in the non-use position away from the sewing machine 30 to clear the area around the sewing machine for service work. The trimmer is shown in the active use position in full lines in FIG. 4.

In a similar manner, the base 43 of the sewing machine 30 has its rear end hinged or pivoted at 44 to the carriage plate 27 on an axis extending longitudinally of the track 22 and at right angles to the pivotal axis 42 of trimmer 31. This mounting enables the sewing machine 30 to be swung upwardly for servicing without removing it from the carriage, as shown in broken lines in FIG. 3. The arrangement is simple and reliable and saves considerable time and labor particularly when minor repairs or adjustments of the equipment are needed, and it is desired not to shut down the entire machine for any appreciable time.

The sewing machine stitching means, yet to be described, is powered by an electric motor 45 suitably mounted on the bottom of the carriage plate 27 and this motor also serves to propel the carriage plate along the railway frame 20 during carpet butt seaming operations. The shaft of the motor 45 extends transversely of the tracks 22 and the rearward end of the motor shaft 46 is connected with a belt transmission means 47 which extends upwardly through a slot 48 in carriage plate 27 and is coupled with the sewing machine drive shaft 49. The motor shaft 46 also powers a second belt transmission means 50 just inwardly of the means 47, and the belt means 50 extends forwardly of the motor 45 and is coupled to the input shaft 51 of a gear speed reducer 52, also secured to the bottom of carriage plate 27. The two shafts 46 and 51 are parallel and at right angles to the tracks 22.

The output shaft 53 of speed reducer 52 is connected through a U-joint 54 with an electric clutch 55 which, when energized, transmits power from the shaft 53 to a driving sprocket gear 56 for the carriage plate 27. The driving sprocket gear 56 engages the bottom of a length of sprocket chain 57 extending along one side of the railway frame 20 with its opposite ends attached to the ends of the frame 20. Thus, the length of chain 57 is a stationary element in the drive system for the carriage plate 27. A pair of idler sprocket gears 58 close to and on opposite sides of the driving sprocket gear 56 engage the top of sprocket chain 57 to maintain a rolling slack loop 59 therein as the carriage moves lengthwise of the frame 20. The three sprocket gears 56 and 58 are bodily mounted on the carriage plate 27 so that they may travel along the chain. A bracket means 60 is provided on the carriage, FIG. 5, for the support of the idler sprocket gears 58 on a pair of short stub shafts 61, as shown.

Whenever the motor 45 is energized to operate the sewing machine, the electric clutch 55 will also be energized so that the sprocket gear 56 will be driven by the motor to advance the carriage plate 27 on the tracks 22 in the direction of the arrow in FIG. 1 during a carpet butt seaming operation.

When the motor 45 is turned off, the clutch 55 will be de-energized, thus rendering sprocket gear 56 free-wheeling. This allows the carriage plate with the sewing machine and trimmer to be returned manually to the upstream end of the railway frame prior to the start of a new seaming operation and allows the carriage plate to be moved freely to any position on the tracks 22 without interference from the sprocket gearing which is free-wheeling, as stated.

As shown in FIG. 1, a control post 62 on the carriage plate 27 mounts a pair of on and off switches 63 for the two motors 45 and 35 of the sewing machine and trimmer, respectively.

As previously mentioned, a modified conventional sewing machine is utilized for the stitching of the thick carpet layers which may have a total thickness of two inches. The machine has been modified to provide the necessary increased needle stroke and looper movement to perform the necessary operations. Additionally, the customary feed dog means of the sewing machine has been removed, inasmuch as the machine is propelled on the railway track support or frame 20 relative to the carpet which is held by the described clamping means. Therefore, there is no necessity for a feed dog.

Figure 6:
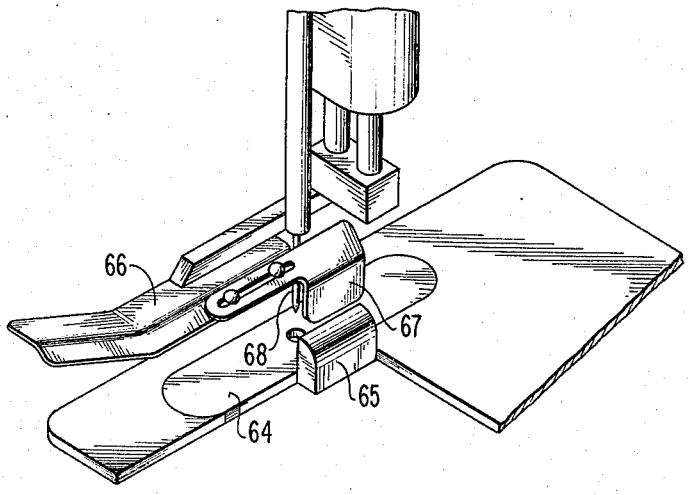
FIG. 6 is a perspective view of an improved arrangement of presser foot and throat plate utilized on the sewing machine.

Additionally, as shown in FIG. 6 and elsewhere in the drawings, a modified sewing machine throat plate 64 is provided in the invention having an upstanding abutment 65 to engage and position the trimmed edge of the carpeting as the sewing machine moves therealong with the carriage plate 27. Similarly, a modified large sheet metal presser foot 66 is employed to accommodate large carpet thicknesses, and the presser foot includes an adjustable downturned lip or flange 67 in spaced opposed relation to the abutment 65 and traveling along the trimmed edge of the carpet layers 33 and 34 during the butt seaming operation.

The modified and improved stitch forming means of the sewing machine shown particularly in FIGS. 7 through 13 of the drawings forms a very important and critical feature of the invention, in that the arrangement allows the machine to form butt seam stitching unfailingly with a precisely controlled amount of slack in the stitching which permits the proper "butting out" of the carpet illustrated in FIG. 16 without an unsightly gap or buckling or overlapping which would occur if too much or too little slack were allowed in the stitching.

More particularly, the improved stitching mechanism comprises the usual reciprocating machine needle 68 by means of which the primary stitch-forming thread 69 is carried through the superposed carpet layers 33 and 34 to be joined with a butt seam, as shown in FIG. 16. A first looper 70 on a rocker shaft 71 in the base of the sewing machine 30 cooperates with the needle 68 in a known manner to carry a second thread 72 into interlocking relation with the primary thread 69 as shown in sequence views FIGS. 7 through 13. FIGS. 14 and 15 also picture the interlocking of the two threads 69 and 72 in the stitching forming the carpet butt seam. A cooperating large looper 73 on an independent rocker shaft 74 in the base of the sewing machine oscillates in timed relation with the looper 70 in the formation of the interlocking stitching according to a general mode of operation which is well-known in the art and graphically illustrated in the drawings with clarity, and therefore need not be described in great detail.

In the invention, however, the looper 73 carries a unique and critical longitudinal finger attachment 75, which is the key element in the formation of the required slack in the stitching to allow the proper butting out of the carpet seam in FIG. 16.

Figure 7:
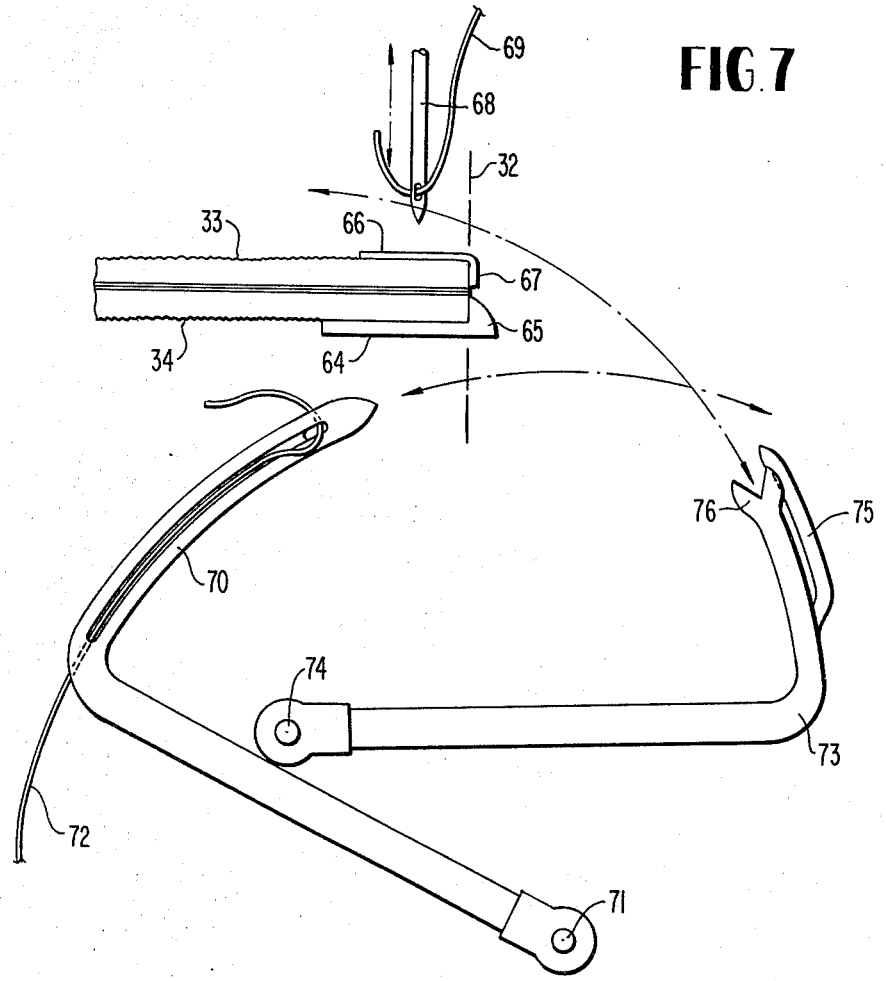
Figure 8:
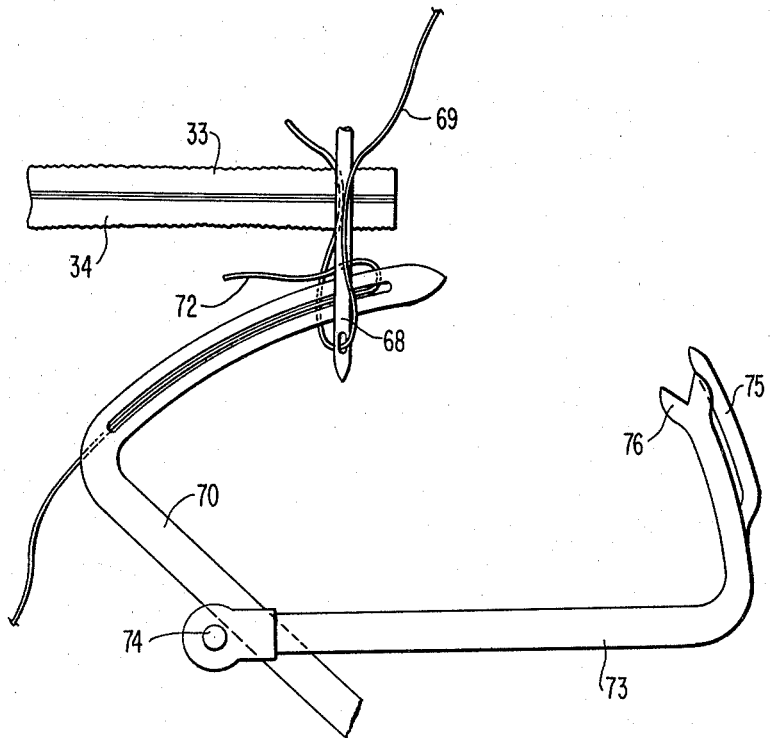

The preliminary conventional steps of the stitch formation are shown in FIGS. 7 through 12 where initially the needle carrying the primary thread 69 and the looper 70 with secondary thread 72 coact as illustrated. In FIGS. 7 and 8, the needle 68 carries the thread 69 through the two carpet layers 33 and 34 and produces a thread loop below the carpet layers. Substantially simultaneously in FIGS. 8, 9 and 10, the looper 70 carries the secondary thread 72 through the loop of the thread 69 beneath the carpet and carries the loop formed in the thread 72 well beyond the trimmed edges of the two carpet layers.

Following this, in FIGS. 11, 12 and 13, the second looper 73 by means of its forked end 76, a conventional feature, picks up the loop in thread 72 as the looper 70 is retracted, and carries this loop around the trimmed edges 77 of the carpet layers as clearly depicted in FIG. 13. On the next down stroke of the needle 68, FIGS. 13 and 14, the thread 69, when being passed through the carpet layers, will cause a repetitive interlocking of the thread 69 with the bights 78 of the loops in the thread 72. It may be mentioned here that the far side of FIG. 14 represents the trimmed carpet edges 77 around which the loops of thread 72 are drawn by the looper 73, and the near side of FIG. 14 shows the carpet layers cut off at the plane of the loops in thread 69 where these loops pass through the carpeting and are interlocked at the bottom of the two carpet layers with the thread 72. Again, as thus far described, the formation of the stitching is largely conventional except for the modifications of the sewing machine to permit increased needle and looper strokes necessary to accommodate thick carpeting.

The critical and necessary action of the finger 75 takes place in FIGS. 12 and 13 to provide the previously mentioned precise amount of slack in the stitching thread 69 to allow the proper butting out of the splice when the joined carpet sections 33 and 34 are unfolded, as shown in FIG. 16, with their pile faces downwardly and the butt seam stitches of the thread 69 facing upwardly through the carpet backing material. As shown particularly in FIG. 13, this required slack in the thread 69 is developed during each descent of the needle 68 after its first descent through the carpet in FIGS. 7 and 8. During each following descent of the needle, FIG. 13, the thread 69 carried by the eye of the needle is pulled across the top of the finger 75 thus creating the extra slack in the thread or yarn 69 as the looper 73 is withdrawn toward its original position. This extra slack formed by the action of the finger 75 is very essential in assuring the proper butting out of the splice between the two carpet sections, as discussed previously.

When the butt seaming operation progresses in the described manner across the full width of the two carpet layers while they are clamped in the machine, the sewing machine and trimmer are turned off and this deactivates the clutch 55 and the clamp bar 23 is deactivated and raised to release the spliced carpet layers which would now appear as in FIG. 15. The two layers are now unfolded into a flat plane which is the butting out operation referred to above and the product will then appear as in FIG. 16. FIG. 17 merely shows schematically the relationship of an old or nearly spent carpet roll 37 relative to a fresh roll 38 with which it is being spliced or butt seamed by means of the invention. In FIG. 17, the carpet backing layers are face-to-face and the carpet piles are outermost, as in FIG. 15 and FIGS. 7 through 14.

Another feature which should be emphasized is the arrangement whereby the trimmer blade 32 traveling on the frame 20 immediately ahead of the stitch-forming means removes the carpet scrap cleanly and allows it to fall on the floor so as to avoid any possible entanglement with the stitch-forming means. Also the trimmer blade is arranged as close as possible to the vertical plane of the sewing machine needle, as indicated by the phantom lines 32 in FIG. 7 and also in FIG. 3, in the interest of reducing the carpet scrap and wastage to an absolute minimum.

It is to be understood that the form of the invention herein shown and described is to be taken as a preferred example of the same, and that various changes in the shape, size and arrangement of parts may be resorted to, without departing from the spirit of the invention or scope of the subjoined claims.

We claim:

1. A machine for butt seaming two carpet sections comprising a horizontal railway sewing machine frame including spaced parallel frame sides, a vertically movable power operated carpet clamping bar arranged above and extending lengthwise of one frame side for clamping superposed carpet sections in fixed relationship at the top of said frame, a pair of parallel longitudinal tracks on said frame sides below the tops of the frame sides and substantially coextensive lengthwise therewith, a carriage plate having opposite side guide rollers disposed between the frame sides with the guide rollers engaging and supported by said tracks, a sewing machine mounted bodily on the carriage plate between the frame sides and extending transversely of the frame sides and tracks with its sewing head facing one frame side and clamping bar and being approximately at the elevation of the top of said frame, said sewing machine pivoted to the carriage plate on a pivot axis parallel to said tracks whereby the sewing machine may be rocked upwardly on its pivot and rearwardly away from said clamping bar and the underlying frame side, a power driven rotary carpet edge trimmer on the carriage plate closely in advance of the sewing machine and having a transverse horizontal axis cutter blade operating in a vertical plane and spaced slightly laterally inwardly of the sewing head needle means with reference to said clamping bar, said trimmer pivoted to the leading portion of said carriage plate on a pivot axis transverse to said tracks and substantially at right angles to the pivot axis of said sewing machine, a sewing machine drive motor secured to the bottom of the carriage plate and having transmission gearing operatively connected to the sewing machine above said plate, a length of sprocket chain disposed at an elevation below the carriage plate and said tracks and extending lengthwise of said frame with its ends attached to the opposite frame ends, said chain arranged near the frame side having said clamping bar above it, a carriage driving sprocket gear engaged with said chain and operable to propel said carriage plate, sewing machine and trimmer along said tracks, and an electric clutch means coupled between said driving sprocket gear and said sewing machine drive motor whereby said sprocket gear is powered by said clutch means only when said drive motor is energized and is free-wheeling when the motor and clutch means are de-energized.

2. A machine as defined by claim 1, and said sewing machine having a throat plate provided with an upstanding abutment engageable with the trimmed carpet edge, and a cooperating presser foot having a dependent flange above and in alignment with said abutment to also engage said trimmed edge.

3. A machine for butt seaming carpet sections comprising a railway sewing machine frame, power-operated carpet clamping means extending along one side of the frame, a carriage structure mounted for longitudinal movement on said frame, stitch forming means and carpet edge trimming means on the carriage structure to move therewith with the trimming means in advance of the stitch forming means, a drive motor for the stitch forming means on the bottom of the carriage structure and drivingly coupled with the stitch forming means, transmission means on the bottom of the carriage structure coupled with said drive motor and including an electric clutch, cooperative drive gearing for the carriage structure on the frame and carriage structure including a rotary drive element on the carriage structure coupled to said clutch and driven through the clutch when the latter and the drive motor are energized and being free-wheeling when the clutch and motor are de-energized to allow free manual shifting of the carriage structure on said frame in any direction, said stitch forming means comprising a vertically reciprocating needle for carrying a primary thread through superposed carpet sections, a cooperating presser foot and throat plate between which the carpet sections are held by the clamping means during a butt seaming operation and each having a vertical edge abutment following the trimmed edges of the carpet sections during butt seaming, a pair of cooperating loopers mounted for timed oscillatory movement below said throat plate, one looper carrying a secondary thread which interlocks with the primary thread during the butt seaming operation, the other looper adapted to engage secondary thread during retraction of said one looper and to carry loops of the secondary thread around the trimmed edges of the carpet sections, and a finger extension on the top of said other looper and moving therewith into the path of descent of said needle, whereby and primary thread carried by the needle is caused to pass over said finger extension transversely during the interlocking stitch formation, the finger extension forming extra slack in the primary thread at the points where such thread passes over the finger extension and said extra slack allowing the butt seam carpet sections to butt out properly upon completion of the seaming operation.

4. A machine as defined in claim 3, and said finger extension comprising an elongated element attached to the top arm of said other looper in closely spaced parallel relation to the top arm and extending slightly ahead of the forked tip of the top arm whereby the primary thread will unfailingly pass over the top of the finger extension.

* * * * *